United States Patent [19]

Okano

[11] Patent Number: 4,703,320

[45] Date of Patent: Oct. 27, 1987

[54] CHARACTER PATTERN STORAGE AND DISPLAY DEVICE

[75] Inventor: Keisuke Okano, Tsuzuki, Japan

[73] Assignee: Matsushita Electric Industrial Co., Ltd., Kadoma, Japan

[21] Appl. No.: 642,598

[22] Filed: Aug. 20, 1984

[30] Foreign Application Priority Data

Aug. 24, 1983 [JP] Japan ..... 58-155181

[51] Int. Cl.[4] ..... G09G 1/16

[52] U.S. Cl. ..... 340/731; 340/750; 340/744

[58] Field of Search ..... 340/723, 724, 731, 744, 340/748, 750

[56] References Cited

U.S. PATENT DOCUMENTS

| | | | |
|---|---|---|---|
| 3,568,178 | 3/1971 | Day | 340/748 |
| 3,729,714 | 4/1973 | Heard | 340/724 |
| 3,877,007 | 4/1975 | Fishman | 340/724 |
| 3,946,407 | 3/1976 | Ishii et al. | 340/724 |
| 4,054,948 | 10/1977 | Grier et al. | 340/724 |
| 4,246,578 | 1/1981 | Kawasaki et al. | 340/724 |
| 4,323,892 | 4/1982 | Kinghorn | 340/724 |
| 4,342,990 | 8/1982 | Traster | 340/724 |

*Primary Examiner*—Marshall M. Curtis

*Attorney, Agent, or Firm*—Wenderoth, Lind & Ponack

[57] ABSTRACT

A character pattern storage and display device stores information descriptive of a character, information representative of the amount of downward shift to be effected to a character pattern of the character, information representative of the width of the character to be displayed, and, where the character is to be displayed with its width changed, information representative of the start position of an actual character in the information stored. A control circuit is provided for moving the position at which the character is displayed on the basis of such information.

1 Claim, 9 Drawing Figures represents 8-bit width
" 1-bit "
" 2-bit "
" 3-bit "
" 4-bit "
" 5-bit "
" 6-bit "
" 7-bit "

To start from 1st bit
To start from 2nd bit
To start from 3rd bit
To start from 4th bit
To start from 5th bit
To start from 6th bit
T start from 7th bit
To use only 8th bit

CHARACTER PATTERN STORAGE AND DISPLAY DEVICE

BACKGROUND OF THE INVENTION

The present invention relates to a character pattern storage and display device for displaying an alphanumeric symbol, stored in a given bit pattern, in the form of a character having a different character width and shifted or non-shifted information of the character pattern for the downward direction.

In a proportional spacing mode, some alphabet letters have a relatively small character width such as, for example, "i" and "l". If these letters of small character width are to be displayed after being taken out from a memory in which these letters are stored as patterned in respective frames of a given size, they tend to result in the increased space between one character of a small character width and the neighboring character of a normal character width. Moreover, when it comes to such letters as "j", "p" and "q", they have to be shifted downwards in a longitudinal direction relative to the base line common to all other alphabet letters except for "g", "j", "p", "q" and "y".

Hitherto, a method is known for providing information indicative of the necessity of the downward shift of some characters at the time they are to be stored. However, this known method requires the use of a complicated and expensive device to practice it because a display device capable of displaying characters of different character width requires complicated processing procedures such as the specification of a particular character width for a certain character, and that of the position at which a certain character is to be displayed.

SUMMARY OF THE INVENTION

The present invention has for its object to provide the improvement wherein, when some characters are stored in respective memories of the same bit pattern, some of the characters to be displayed are shifted in the longitudinal direction and/or a margin in the bit pattern of a particular character is erased so that a uniform space can be obtained between adjacent characters constituting a word. This can be accomplished by, at the same time as characters are stored, storing pieces of information concerning the start position at which a particular character is to be displayed, the width of a display area in which a particular character is to be displayed, and the amount of shift in the vertical direction, for each of the the characters and controlling the character display based on these pieces of information.

BRIEF DESCRIPTION OF THE DRAWINGS

This and other objects and features of the present invention will become clear from the following description taken in conjunction with a preferred embodiment thereof with reference to the accompanying drawings, in which.

DETAILED DESCRIPTION OF THE EMBODIMENT

Figure 1:
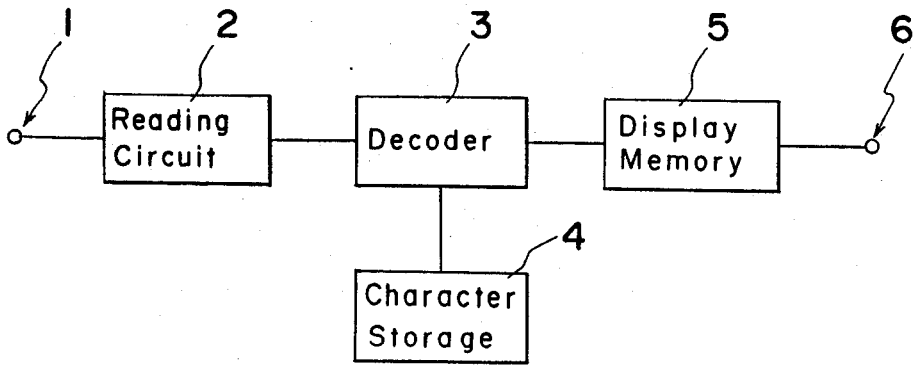
FIG. 1 is a schematic block diagram showing a circuitry of a character display device in which the present invention is utilized.

FIG. 1 illustrates schematically the circuitry of a character display device utilizing the present invention. Reference numeral 1 represents an input terminal to which character information is supplied. This input terminal 1 is connected through a reading circuit 2 to a decoder 3 for decoding data read in. A character storage unit 4 is connected to the decoder 3 according to the present invention. The decoder 3 is in turn connected through a display memory 5 to an output terminal 6 from which an output is fed to a display unit. Both a character information signal and a control signal are read in by the reading circuit 2 and are then decoded by the decoder 3. This decoder 3 is constituted by a microcomputer, a program read-only memory and other component parts and is operable to read in character information from the character storage 4 based on the information decoded thereby, and then to sequentially write it in the display memory 5. The contents of the display memory are outputed from the output terminal 6 to the display unit such as, for example, a cathode ray tube, at which they are sequentially displayed. The character storage 4 constituting the present invention will now be described.

Figure 2A:
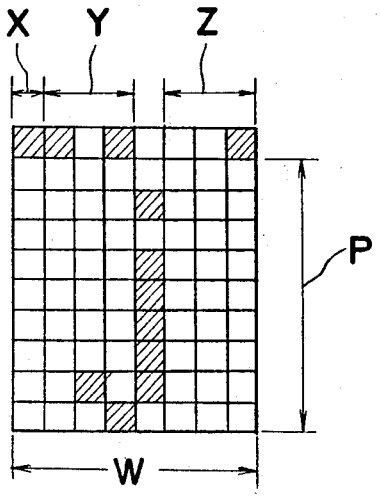
FIG. 2 is a schematic diagram showing different manners in which a character pattern is stored in a character storage and display device.
Figure 2B:
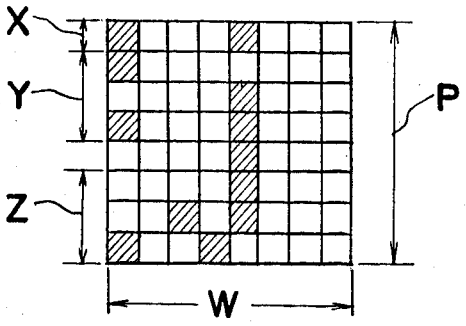

FIGS. 2(*a*) and 2(*b*) illustrate respective patterns in which a character is stored. Each of these patterns has information X representative of the necessity of a shift to be effected to move the position at which a character pattern is displayed, and information Y representative of the character width, and information Z representative of the effective start position for a character, and pixel information P of a character, this information being utilized to display a particular character. It is to be noted that FIG. 2(*a*) illustrates an example wherein the information, except for the information P, is stored in an upper end area of the character pattern whereas FIG. 2(*b*) illustrates an example wherein the information, except for the information P, is stored in a front end area of the character pattern. It is also to be noted that the same bit pattern is used for all of the characters.

Figure 3:
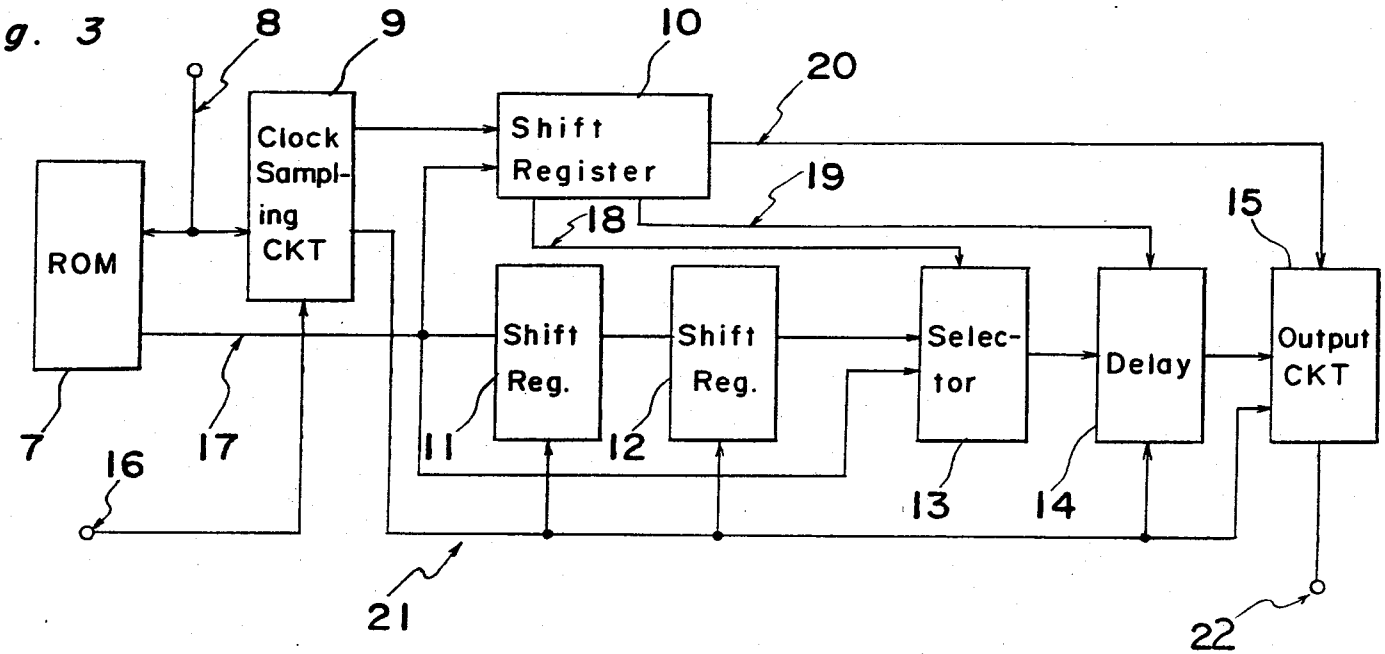
FIG. 3 is a block diagram showing a shift circuit used in the character storage and display device.

FIG. 3 illustrates a control circuit for controlling an output of a character pattern signal based on the information X, Y, Z and P. Reference numeral 7 represents a read-only memory for storing character information; reference numeral 8 represents an address signal input terminal for reading out a character stored in ROM 7; reference numeral 9 represents a clock sampling circuit capable of generating trains of eight clock pulses according to an address decoding; reference numerals 10, 11 and 12 represent respective 8-bit shift registers, reference numeral 13 represents a selector circuit fed by a signal line 18; reference numeral 14 represents a variable delay circuit fed by a signal line 19; reference numeral 15 represents an output circuit, and reference numeral 16 represents a clock input terminal. Reference numeral 17 represents an output signal from ROM 7; reference numeral 18 represents a result of shift information contained in ROM 7; reference numeral 19 represents the start position information contained in ROM 7, that is, delay information, reference numeral 20 represents the character width information; reference numeral 21 represents a clock from which a clock associated with a control data section is removed, and reference numeral 22 represents an output signal terminal.

Figure 4:
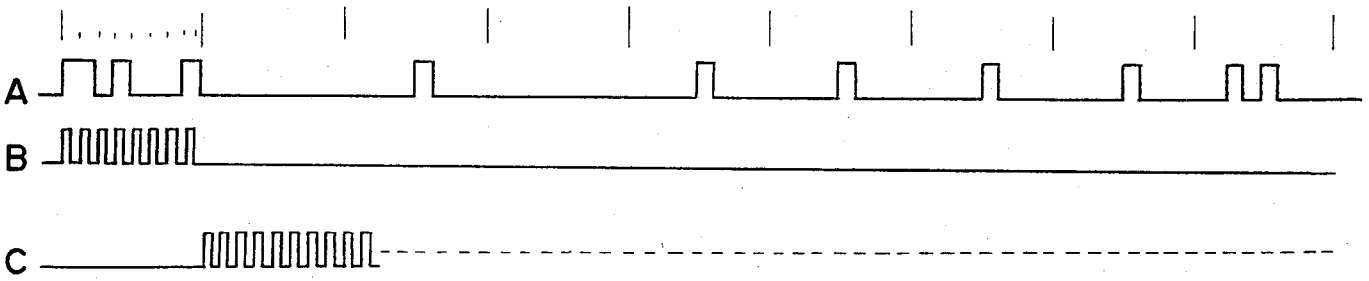
FIG. 4 is a diagram showing waveforms of signals appearing in the circuit of FIG. 3.

The first 8-bit data is read out from ROM 7 in response to the address signal input to terminal 8, and the shift information X (shifted in FIG. 2(*a*)), the width information Y (5-bit width in FIG. 2(*a*)) and the start position information Z (in FIG. 2(*a*), start from the second bit position) are stored in the shift register. By the utilization of the shift registers 11 and 12, a 16-bit delay, that is, a 2-line delay, is effected. The selector 13 is fed by the signal line 18 to select either the 2-line shifted data or the data which is not delayed. The variable delay circuit 14 receives respective signals from the shift register 10 and the selector 13 and is fed by the signal line 19 from the shift register 10 to determine the amount of delay by selecting a data of a given delay amount. In other words, the delay circuit 14 serves to determine the display start position by delaying the character pattern signal on the basis of the information Z shown in FIG. 2. The output circuit 15 effects a serial-parallel conversion to of an output from the delay circuit 14 and, thereafter, generates an output. In other words, the output circuit 15 serves to determine the character width by outputing the character pattern signal on the basis of the information Y shown in FIG. 2. At this time, the timing of the serialparallel conversion is determined by the character width information, fed from the shift register 10 through the signal line 20, and the clock 21. Simultaneously therewith, this character width information has to be outputed from the output circuit 15. The output circuit 15, when supplied with an output signal from the delay circuit 14, generates, at terminal 22, an effective data representative of the predetermined width based on the character width control information fed from the shift register 10. The effective data so fed to the terminal 22 is in turn fed to the display memory 5, shown in FIG. 1, and is subsequently displayed on a display device. FIG. 4 illustrates the various waveforms of signals used to explain the sequence of this operation, it is to be noted that the waveforms shown in FIG. 4 are applicable where the output from the ROM 7 is in the form of a serial signal, each 8-bits corresponding to one line and a character "j" being decomposed into serial signals. In FIG. 4, reference character B represents the waveform of a signal from which 8 clocks are sampled out after the address decoding and which is used for reading control information. Reference character C represents the waveform of a clock of a duration other than the control information, which is used as a timing signal for a one-line shift circuit, the variable delay circuit and a serial-parallel conversion circuit.

Figure 5A:
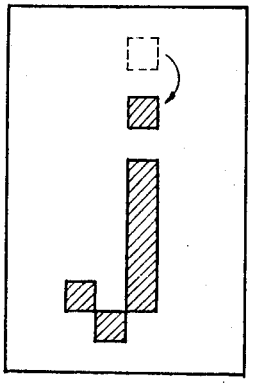
FIG. 5 is schematic diagrams showing the manner by which a character is displayed.
Figure 5B:
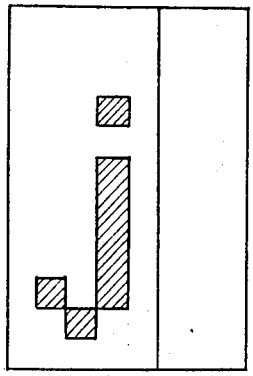

Depending on the mode of display, it may happen that the character width need not be always changed for each of the characters. Where no change of the stored character width W is necessary for a character to be displayed, the character bit pattern is shifted downwards in a direction shown by the arrow in FIG. 5(*a*) in dependence on the necessity of the shift and is then displayed. Where the character width W including a margin is to be changed for each character, by the utilization of the information X, Y and Z, the character pattern is shifted downwards and the character width is then changed as shown in FIG. 5(*b*). In other words, in FIG. 5(*a*), the character display pattern including the space is shown as shifted 2 bits downwards in the longitudinal direction while the character width W remains unchanged. On the contrary thereto, in FIG. 5(*b*), the character display pattern is shown as shifted 2 bits downwards in the longitudinal direction as is the case shown in FIG. 5(*a*), but the character width W of the character displayed is reduced 3 bits.

Figure 6:
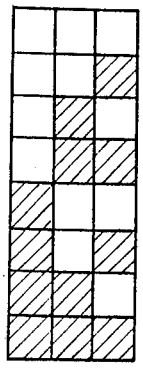
FIGS. 6 and 7 are schematic diagrams showing examples of information concerning the character width and the display start position of a character.
Figure 7:
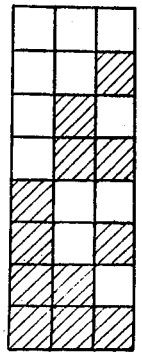

FIG. 6 illustrates an example of the character width information, and FIG. 7 illustrates an example of the information representative of the effective start position of the character.

The foregoing is a preferred embodiment of the present invention wherein an area of 1 byte is provided for the information X, Y and Z. In such case, a margin of 1 byte is always present at a left-hand portion of the character as shown in FIG. 2(*b*) or a a right-hand portion thereof and, accordingly, it is possible to insert the information X, Y and Z in that margin. Where the information X, Y and Z is inserted in the manner as hereinabove described, they must be removed when the relevant character is to be displayed and, however, it is possible to reduce by one byte the capacity of the memory for the storage for each of the characters.

Because of the use of the information informing the necessity of the downward shift, there is no need to store the character in the form as downwardly shifted and the storage capacity of the memory can advantageously be reduced. In addition, because of the use of both the information concerning the character width and the information concerning the start position, a simple structure can be employed for both cases wherein the character width is changed for each character stored in the same bit pattern and wherein each character is to be displayed without the character width thereof changed.

Although the present invention has fully been described in connection with the preferred embodiment thereof with reference to the accompanying drawings, it is to be noted that various changes and modifications are apparent to those skilled in the art. Such changes and modifications are, unless departing from the scope of the present invention as defined by the appended claims, to be understood as included therein.

We claim:

1. A character pattern storage and display device which comprises:

a storing means for storing character data including a character bit pattern descriptive of a character, shift information representative of a vertical shift to be effected to said character bit pattern, width information representative of a spacing with respect to a neighboring character bit pattern, and position information representative of start position of display of said character bit pattern, said shift information, width information and position information being stored in a predetermined format within said character data;

a designating means for designating and producing said charater data from said storing means;

a reading means for reading and separating said shift information, said width information and said position information from said produced character data;

a shift control means for controlling the vertical shift to be effected to said character bit pattern, in accordance with said shift information;

a width control means for controlling the spacing with respect to a neighboring character bit pattern, in accordance with said width information;

a position control means for controlling the start position of display of said character bit pattern, in accordance with said position information; and an output means for outputting said character bit pattern to be displayed.

* * * * *